US005848499A

United States Patent [19]

Schildge, Jr.

[11] Patent Number: 5,848,499

[45] **Date of Patent: *Dec. 15, 1998**

[54] CABLE-STAY RETRACTABLE SKYLIGHT ROOF FOR STADIUM OR ARENA OR OTHER STRUCTURE AND METHOD OF CONSTRUCTION OF SAME

[76] Inventor: Adam T. Schildge, Jr., 899 Green St., San Francisco, Calif. 94133

[ * ] Notice: The term of this patent shall not extend beyond the expiration date of Pat. No. 5,653,066.

[21] Appl. No.: 904,513

[22] Filed: Aug. 1, 1997

Related U.S. Application Data

[63] Continuation of Ser. No. 547,668, Oct. 17, 1995, Pat. No. 5,653,066.

[51] Int. Cl.[6] ..... E04B 7/16; E04H 3/10

[52] U.S. Cl. ..... 52/66; 52/6; 52/83

[58] Field of Search ..... 52/6, 66, 22, 80.2, 52/83

[56] References Cited

U.S. PATENT DOCUMENTS

| | | | |
|---|---|---|---|
| 3,510,996 | 5/1970 | Popil . | |
| 3,579,932 | 5/1971 | Atkinson . | |
| 4,587,775 | 5/1986 | Lewis et al. . | |
| 4,676,033 | 6/1987 | Allen et al. . | |
| 4,682,449 | 7/1987 | Berger | 52/66 |
| 4,716,691 | 1/1988 | Allen et al. . | |
| 4,727,688 | 3/1988 | Kida et al. . | |
| 4,738,057 | 4/1988 | Logan . | |
| 4,802,314 | 2/1989 | Schildge, Jr. . | |
| 4,831,792 | 5/1989 | Berger . | |
| 4,920,707 | 5/1990 | Moskaliuk et al. . | |
| 4,942,698 | 7/1990 | Kumagai . | |
| 4,995,203 | 2/1991 | Brisbin et al. . | |
| 5,010,695 | 4/1991 | Schildge, Jr. | 52/6 |
| 5,027,565 | 7/1991 | Sugizake . | |
| 5,035,093 | 7/1991 | Parazader et al. . | |
| 5,063,730 | 11/1991 | Muramoto et al. . | |
| 5,070,659 | 12/1991 | Brisbin et al. . | |
| 5,117,594 | 6/1992 | Muramoto et al. . | |
| 5,167,097 | 12/1992 | Robbie et al. . | |
| 5,257,481 | 11/1993 | Reppas et al. . | |
| 5,257,485 | 11/1993 | Kawaguchi et al. . | |
| 5,283,993 | 2/1994 | Sprung, Sr. . | |
| 5,347,773 | 9/1994 | Thil . | |
| 5,351,449 | 10/1994 | Allen et al. . | |
| 5,355,641 | 10/1994 | Levy | 52/66 |
| 5,388,376 | 2/1995 | Henri . | |
| 5,392,564 | 2/1995 | Fechter et al. . | |
| 5,394,659 | 3/1995 | Kawaguchi et al. . | |
| 5,394,660 | 3/1995 | Haris . | |

OTHER PUBLICATIONS

Super Sky Products, Inc./Atria, Inc. brochure, Opening Roof and Wall Systems, "Environments for Leisure," 1994, pp. 1–36.

S. Inglis, "A to Z of the World's Great Grounds," Amsterdam entry, [date unknow—roof to be completed mid–1996], one page.

Milwaukee Sentinel, Feb. 26, 1994, one page.

"Twin Stadiums Proposed," Engineering News Record 1985, one page ( with explanation attached thereto).

*Primary Examiner*—Michael Safavi

*Attorney, Agent, or Firm*—Limbach & Limbach LLP

[57] ABSTRACT

A cable-stay retractable skylight roof and method of constructing the same wherein a large clear span is built over an existing or new athletic stadium or arena or other structure. The principal feature of the roof structure is that it is supported by Cable-Stays to towers standing outside of the stadium and places no vertical weight on the existing stadium. The structure includes a beam framework and roof covering installed over the framework. The covering is fabricated of a clear skylight material to allow sufficient light transmission to permit a natural grass playing field and retracts open to create an open air stadium.

2 Claims, 17 Drawing Sheets

CABLE-STAY RETRACTABLE SKYLIGHT ROOF FOR STADIUM OR ARENA OR OTHER STRUCTURE AND METHOD OF CONSTRUCTION OF SAME

This is a continuation of application Ser. No. 08/547,668, filed Oct. 17, 1995, now U.S. Pat. No. 5,653,066.

TECHNICAL

The invention relates to the structure and the method of construction of a large span steel or other material framed roof built over an athletic stadium or arena. The roof structure is supported by steel Cable-Stays to towers set outside the stadium and to ground anchors. The method of construction is a cantilevering method. The technology utilized is Cable-Stay Technology. The invention is particularly concerned with the construction of a retractable beam framework of the roof with a glass or plastic skylight thereon which can be retracted open to convert the stadium to an outdoor stadium.

RELATED PATENT

This application relates to my U.S. Pat. No. 4,802,314 and U.S. Pat. No. 5,010,695 and is an improvement over the invention forming the subject of those patents in the manner in which the roof is retracted open.

BACKGROUND OF THE INVENTION

The erection of structures utilizing suspension cables or Cable-Stay Technology has existed for some time. For example, many bridges utilize cables extending between towers or from a single tower to suspend a roadway. In addition, many buildings have been designed such that the roof structure is supported by cables. The principal advantage of utilizing cables to support a roof is that large covered buildings can be designed without any internal supports; and quite economically. One example of a structure which benefits from this type of design is an airplane hanger which requires a large area without pillars to permit positioning aircraft. Sporting arenas also benefit from this design since the design provides for unobstructed viewing.

Examples of roof structures designed by the applicant with Cable-Stay Technology can be found in the following U.S. design patents: U.S. Pat. Nos. D260,036, issued Jul. 28, 1981; D270,570, issued Sep. 13, 1983; D274,841, issued Jul. 24, 1984; D274,842, issued Jul. 24, 1984; D274,843, issued Jul. 24, 1984; D305,937, issued Feb. 6, 1990; and in current utility U.S. Pat. Nos. 4,802,314, issued Feb. 7, 1989, and 5,010,695, issued Apr. 30, 1991.

The design patents above relate to the ornamental appearance of Cable-Stay supported structures.

The utility patents above relate to methods of construction of Cable-Stay roofs over existing stadiums or arena and their design.

The invention of this application relates to the construction of a cable stay supported framework of a roof with a glass or plastic skylight thereon which can be retracted open to create an outdoor stadium.

Recently there has been significant amount of interest in covering existing as well as new open air athletic stadiums. As can be appreciated, many stadiums are located in areas where weather conditions make it difficult to hold events whenever desired.

Existing open air stadiums are generally not designed to support the weight of a newly added roof. Thus, in order to build a roof over an existing stadium, significant measures have to be taken to reinforce the stadium walls or build an additional support system. The latter steps, even if possible, can be difficult and expensive. With new stadiums this can be less of a problem.

There has been significant interest in making these roofs retractable to the extent of opening to the air a substantial portion of the roof generally not less than 50% of stadium area.

Also there has been interest in providing means of retaining a natural grass playing field on the stadium floor.

Accordingly, it is an object of the subject invention to provide a new and improved method for constructing such a roof over an existing or new stadium or arena, or other structure that can be retracted open to nearly 50% of the roof area over the stadium and can be built of glass or plastic skylight material.

It is an object of this invention to provide a means of constructing such a roof that is both functional and cost effective to build.

It is an object of this invention to provide a new and improved method of constructing a cable roof structure over an existing or new stadium or arena, which structure will provide unobstructed viewing within the stadium.

It is still another object of this subject invention to provide a new and improved method of constructing a cable roof structure over an existing or new stadium, which structure is capable of supporting a glass or a plastic roof cover to allow for the retention or use of a natural grass cover on the playing field and to provide for the public enjoyment by creating an outdoor atmosphere in both closed and open positions.

It is also another object of this invention to provide a new and improved method of constructing a Cable-Stay roof with a glass or plastic skylight that can be nearly completely retracted open over a stadium.

It is further the object of this invention to provide a roof that allows for natural ventilation by keeping parts permanently open such that costly heating and air handling equipment might not be necessary.

It is further the object of this invention to provide a clear skylight roof cover such that costly additional lighting is not necessary in an existing stadium where tower lighting exists and can project through the skylight roof. It is also the object of this invention to provide a roof that could support a restaurant and/or sightseeing walkways on its surface.

It is also the object of this invention to provide a roof that could support luxury private seating boxes suspended from the roof structure.

It is also the object of this invention to provide a roof that is structurally sound to withstand, besides its own weight and design loading, also high earthquake forces and unusual wind forces, and snow loading.

It is also the object of this Invention to build a roof that can be built by available technology and contractor's experience, available in the marketplace.

It is also the object of this invention to provide a roof that is permanent and has a long life.

It is also the object of this invention to provide a roof that has relatively low operating and maintenance costs.

It is also the object of this invention to provide a roof that fits architecturally with the underlying architecture of the stadium.

SUMMARY OF INVENTION

In accordance with these and many other objects, the subject invention provides a structural design and a method of constructing such a roof over an existing or new stadium.

The structural design is a roof of clear span over the stadium and supported by Cable-Stays to towers outside the stadium and to ground anchors. The roof cover is either plastic or glass and is made retractable by sliding the center area of the roof (131) over a permanent area of the roof structure (133). The roof is outfitted with permanent ventilation louvers where needed and made to overlap the stadium rim it covers allowing a gap between the roof and the stadium rim for ventilation and overlapping in such a way that it also provides partial protection to concourse and other areas around the stadium.

The assembly of the roof structure is accomplished by first constructing two rows of parallel or curved towers on opposite sides of the stadium and tangent to the stadium and then extending Cable-Stays from the towers to ground anchors outside the stadium. Cable-Stays are then extended from these towers and slanted into the stadium to support long beam framing for a roof section cantilevered from each tower and held back in compression thereagainst. The framing for the roof sections may take any of a number of forms. As an example, it may be open web steel joists or it may be a space frame or it may be box steel framing or another framing system. The cantilever construction can be from one side of the stadium and then from the other or from both sides simultaneously. In this manner a stable roof framing is constructed across the stadium from both sides. The roof framing is therewith complete, with the cantilevered sections left free to press against the tower legs gaining their support from Cable-Stays to the towers and in turn to ground anchors.

In practice the roof members are lifted onto the roof by a ground crane and cables attached to the long beam framing members and are then connected to the towers by also another ground crane or by a crane on top of the towers, a top crane. The ground cranes can work from either outside or inside the stadium whichever offers the best accessibility. After the completed roof framing is in place, a roof cover of either glass or plastic skylight material is installed over the framing. This is also lifted onto the roof by the ground crane or it may be installed by helicopter.

Sections of the roof are made retractable by sliding the center area of the roof (131) over a permanent fixed area of the roof (133).

For an existing stadium, lighting towers if present are left in place and existing lighting continues to illuminate the stadium by simply projecting through the clear skylight roof. Additional lighting where needed is added as well on the underside of the roof.

A grass playing field is provided.

The roof is made to overlap the existing or new stadium for ventilation and for partial protection of surrounding concourse areas.

The roof is provided with ventilation louvers as needed.

Elevators in the towers are provided for access to the roof and tower tops.

Walkways with handrails on the roof beams are constructed for maintenance and sightseeing.

A restaurant is built on the roof as desired.

Luxury private seating boxes are built suspended from the roof where desired.

High pressure water jets are installed on the roof for roof cleaning.

Where desired to completely close the roof to the stadium a flexible gasket is attached between the roof and the stadium rim.

BRIEF DESCRIPTION OF THE DRAWINGS

Further objects and advantages will become apparent from the following detailed description taken in conjunction with the drawings in which.

Reference Numbers

Figure 1:
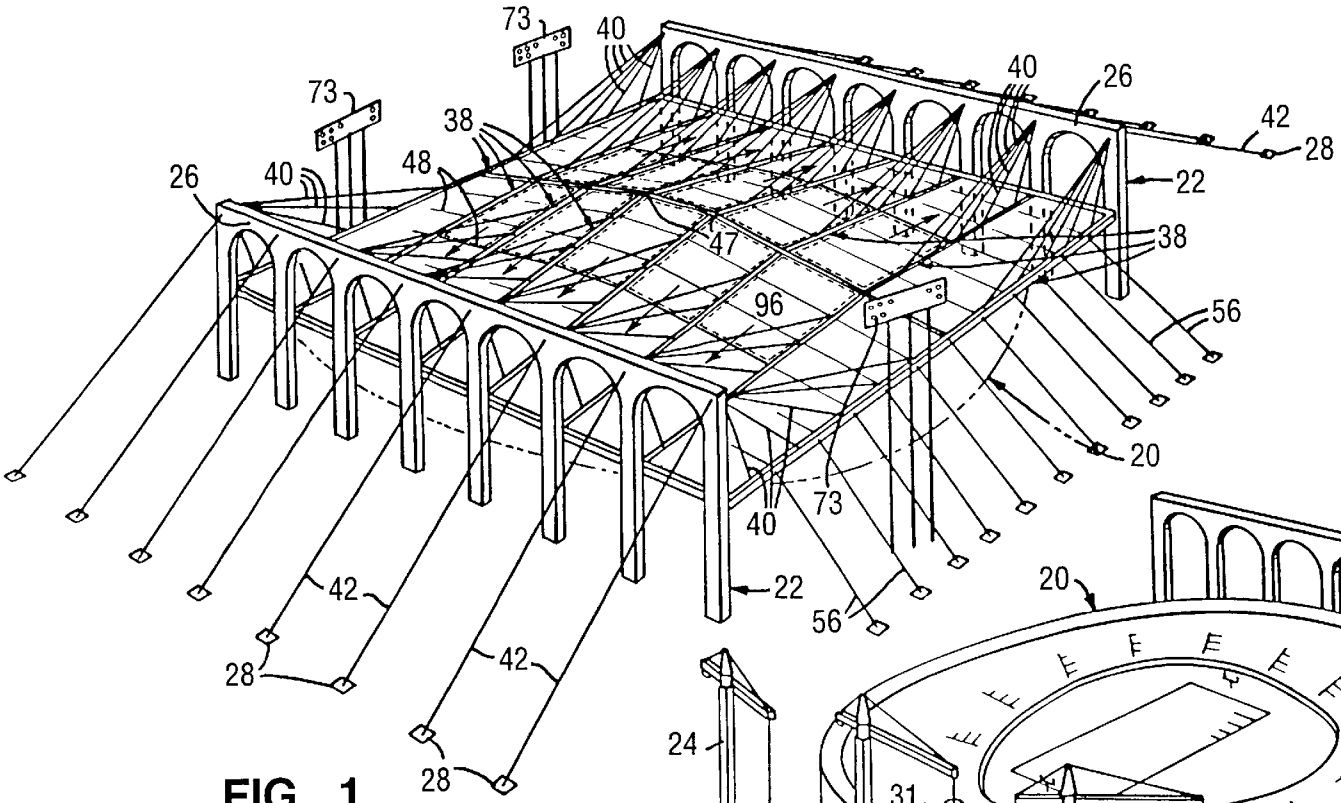
FIG. 1 is a perspective view of the Cable-Stay roof as set over an existing or new stadium or arena.

16 piles
18 foundations
20 stadium
22 towers
24 tower cranes
26 arches
28 ground anchors
29*a* slip form
29*b* slip form
30 ground crane
31 bucket
34 top crane
36 site where roof framing is assembled for lifting to the roof
38 roof long beam framing
38*a* initial long beam framing member
40 Cable-Stays to roof framing
42 Cable-Stays to anchors or back-stays
46 point on the roof where opposite long beams meet at center span
47 peak
48 intermediate roof framing
49 sleeve
50 skylight roof covering
51 cable
52 point where roof long beam framing meets towers
53 turnbuckle
54 cross-cables or struts for cable vibration dampening and enhanced structural stiffness as well as vibration noise control
56 hold-down cables at roof edge providing also partial lateral sidesway support.
57 bolts
58 suspended luxury boxes for private seating
60 roof restaurant
62 water jets for roof cleaning
72 flexible closure gasket between stadium rim and roof
73 stanchion lighting
76 a boatswains chair or basket for access to cables for maintenance
96 sliding framework with skylight thereon
98 wheel
99 axle
100 rail
102 rack
104 pinion gear
106 motor
108 hydraulic cylinder
109 rod attachment to roof
110 rod
112 piston head
114 hydraulic pump
116 wire rope or link chain
118 transmission with motor
119 wire rope or chain connection to roof
120 direct wheel motor
122 moveable roof connector
124 spiral gear thread rod
125 rod support
126 support to spiral gear thread rod
128 support for motor
131 center area of roof
133 permanent area of roof structure over which retractable roof slides
136 retractable roof framing
138 lateral braces
140 raised curb

DETAILED DESCRIPTION OF THE PREFERRED EMBODIMENT

Figure 13:
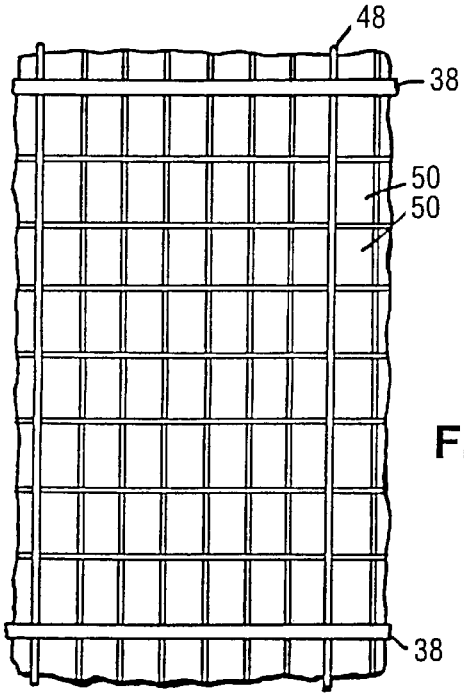
FIG. 13 is an expanded plan view of the intermediate framing between the long beam framing members supporting the roof cover of a glass or plastic skylight.

Turning first to FIG. 1, the basic elements of the Cable-Stay skylight roof structure of the subject invention will be briefly discussed. The roof structure is intended to cover an existing or new open air stadium or arena shown generally by the numeral 20. The Cable-Stay roof structure comprises two rows of towers 22 set in parallel rows on opposite sides of the stadium 20. The towers in each row are connected by arches 26 and rest on foundations 18 and, when needed, piles 16. The roof structure long beam framing 38 is suspended by Cable-Stays 40 from the towers 22 and or their arches 26. This structure is further supported by back-stays 42 to ground anchors 28. Between the long beam framing 38 is intermediate roof framing 48. Over the roof structure 38 and 48 is a roof covering or membrane (see FIG. 13) made of glass or plastic skylight material (50). In the center area of the roof a retractable roof framing (136) with a skylight cover thereon (50) is built that retracts open by sliding over the fixed roof framing and skylight, aforesaid (133).

Having identified the main elements of the Cable-Stay roof structure, the preferred method of assembling this structure over an existing or new stadium or arena will be described in detail.

Figure 2:
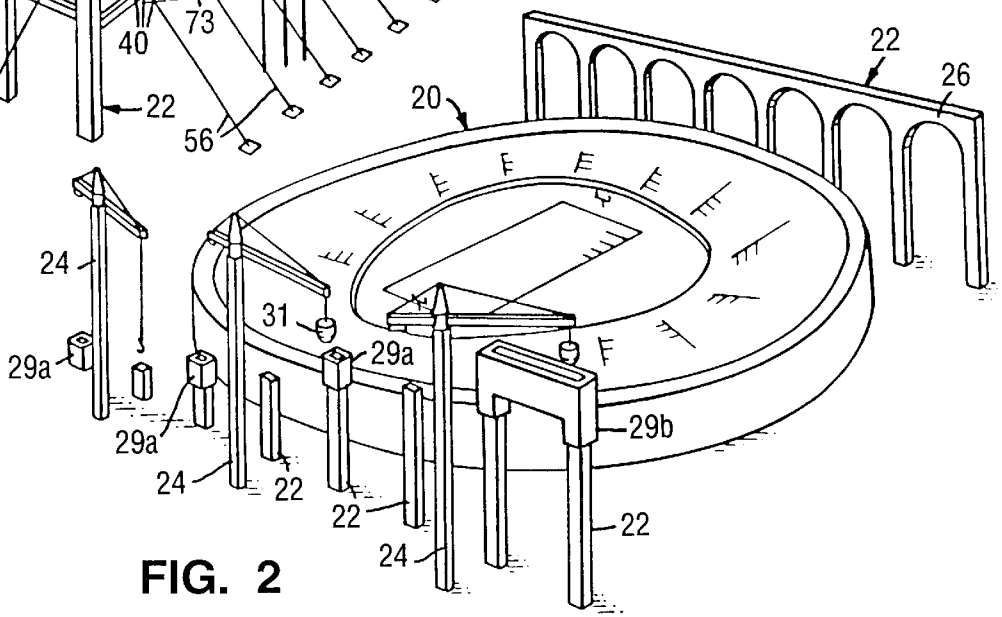
FIG. 2 is a perspective view of the support towers under construction set alongside the existing or new stadium or arena.
Figure 3:
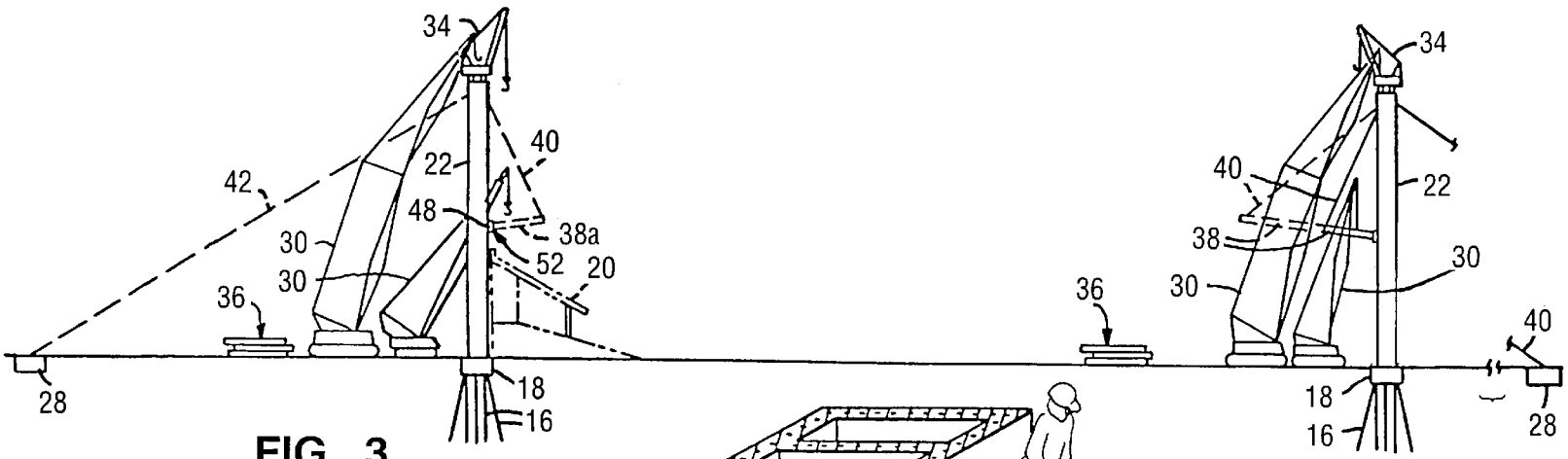
FIG. 3 is a diagrammatic elevational view showing the roof support towers and the initial sequence of the roof construction over a stadium by the cantilever method.

Starting with the stadium 20 in FIGS. 2 and 3, foundations 18, and piles 16 if needed are constructed exterior to the stadium 20. Over these foundations are constructed concrete or steel towers 22 with the use of tower cranes 24. The preferred embodiment has these towers as shown constructed from slip formed concrete in two parallel rows on opposite sides of the stadium. They could also be constructed in steel. As an alternate they may be constructed in two curved planes on opposite sides of the stadium to more nearly fit to the shape of the stadium or they may be set in a circle, an ellipse, or other curved shape around the stadium or other structure. The preferred embodiment would have these tower rows at one point tangent to the stadium but they need not necessarily be tangent and can be set off from the stadium. The towers 22 are then connected at their top by arches 26 to one another for strength. The form of the connection need not necessarily take the form of an arch and could be a lintel, a truss, an angular brace, or any other form of reinforcement; and furthermore this entire connection can also be entirely left out such that the remaining structure of towers resemble simply rows of singular standing towers unconnected at their tops or free standing. The towers which support the roof with Cable-Stays can be entirely free standing without back-stay cables to ground anchors. Furthermore the towers need not necessarily be vertical, but could be tilted outward or even inward to the stadium for structural or architectural reasons. The slip forms as illustrated in FIG. 2 are designated by the numerals 29*a* and 29*b* and are shown as being filled with concrete by buckets 31 carried by the cranes 24.

Once the towers 22 are constructed the roof construction can begin. Although the illustrated embodiment shows roof construction commencing after both rows of towers have been completed, construction can begin after one row of towers is constructed on one side of the stadium. It follows from the drawings that the roof is then constructed inward from these towers by a cantilevered method, either from one side at a time or from both sides simultaneously. Material of the roof structure is raised to the roof from the stadium floor or from outside the stadium by ground cranes 30 and then installed in the cantilever method as each section is correspondingly connected by Cable-Stays to the tower tops. The Cable-Stays 40 are connected to the tower tops by the use of either a top crane 34 mounted on the tops of the towers or by a ground crane 30 reaching to the tops of the towers.

At the same time as the tower construction is commencing, the ground anchors 28 which would be generally of steel, concrete, and pile construction are also constructed. Upon completion of the towers, either before or simultaneously with the commencement of roof construction (as herein described) back stay cables 42 are placed.

Figure 5:
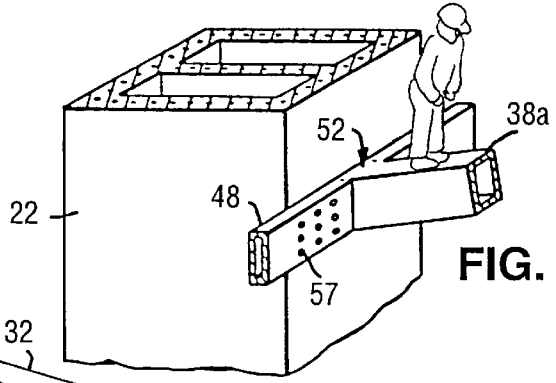
FIG. 5 is an enlarged perspective view, with parts broken away, of a roof long beam framing member where connection is made to the tower leg.
Figure 4:
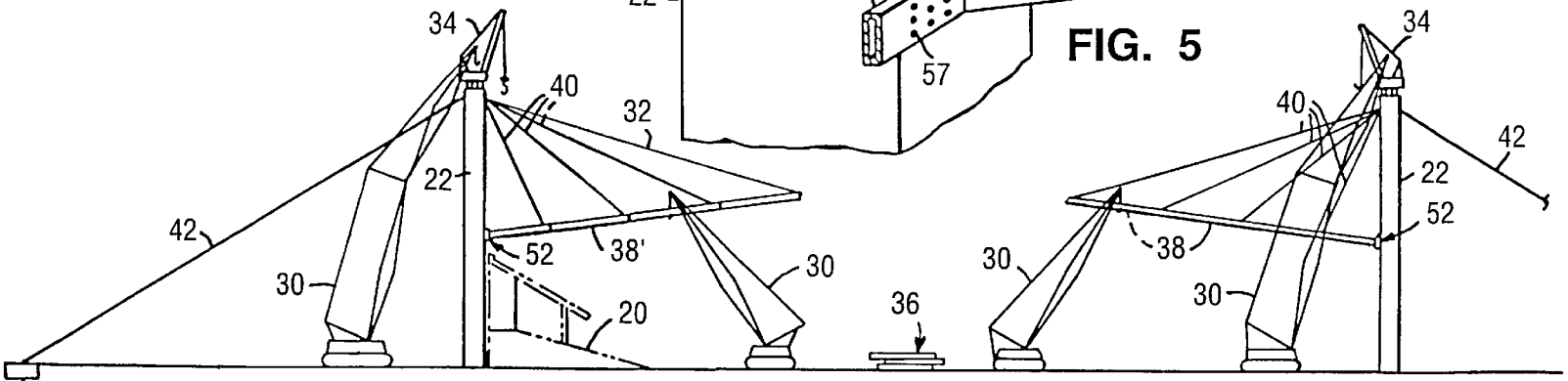
FIG. 4 is a diagrammatic elevational view similar to FIG. 3 showing continuing sequential steps in the cantilevered method.
Figure 6:
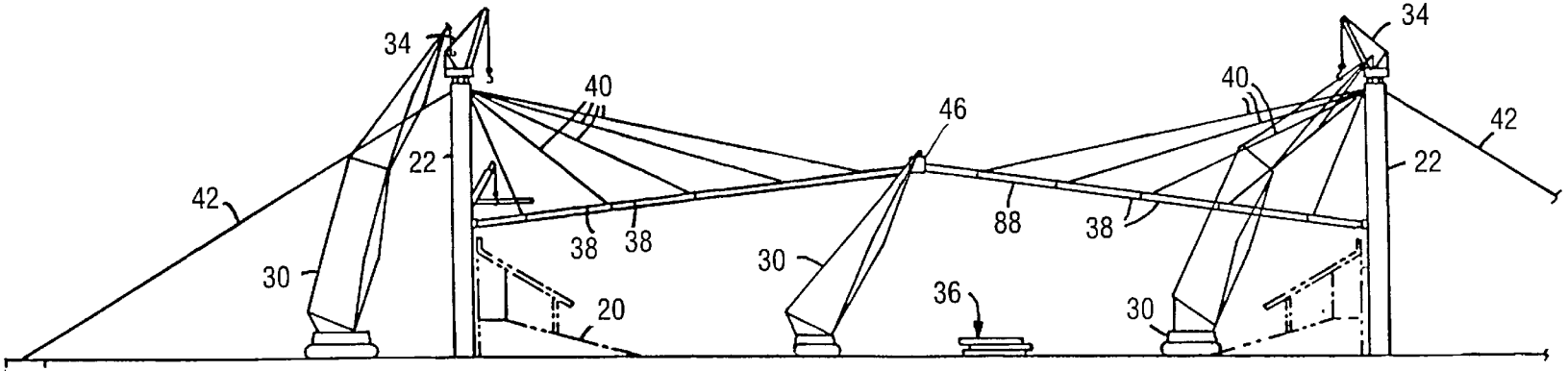
FIG. 6 is a diagrammatic elevational view similar to FIGS. 3 and 4, showing the existing or new stadium or arena and the completed tower assemblies with the cantilevered roof structures complete.
Figure 7:
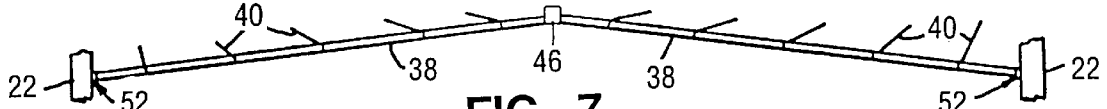
FIG. 7 is a diagrammatic elevational view, with parts broken away, showing the final roof with the framing with Cable-Stays completed.

Following these assemblages, the roof construction itself may now proceed as follows. Prefabricated roof material, generally of steel but also if desired of wood or of concrete or even of other structural material is assembled on the sites at 36 either inside or outside the stadium. Ground cranes 30, FIG. 3, then hoist an initial roof long beam framing member 38*a* into position by hoisting it over the stadium rim between the towers and under the arches to a point on the roof and attaches one end of the framing member to a tower leg where it is connected at 52 (see FIG. 5). As an alternate method a ground crane can hoist the long beam framing member 38*a* from within the stadium to the tower leg where it is attached. Connection is made by an intermediate roof framing member 48 fixed to member 38*a* and bolted to the tower 22 by bolts 57. Attached to the other end of the framing member 38 is a cable 40 which is now pulled to the top of the tower by top crane 34 or by ground crane 30 where it is tensioned by hydraulic jacks and connected to the tower. The cable 40 is of prescribed length and fitted with anchor sockets at both ends. By the use of prefabricated length cables, cables can be later exchanged if needed in the event of damage or corrosion. Such cables may be of the fully galvanized locked-wire type and installed with sufficient tension to provide a tight seal against water intrusion and in turn corrosion or they may be protected by a cover for corrosion protection or they may be of other construction. To install and make tight such cables, a typical end socket is fitted with an extension rod screwed into the end of the cable socket. The cable and rod then can be pulled into place by a winch or pulley and by the top crane 34 or ground crane 30 allowing sufficient sag so that the force to pull the cable and rod can be reasonably handled. Once in place with the cable rod extension in a hydraulic press mounted in the tower, the rod extension is then pulled by the hydraulic press or jack to the very high tension and low sag of the final cable configuration and the cable socket is then firmly anchored in the cable anchorage and the rod extension removed. Shims can then be installed at the socket anchorage to make minor adjustment and the connection of the socket to the structure can also be adjusted by a threaded bolt attached to the outside of the socket to which the connection of the cable to its anchorage is made. In such a manner then the first long beam framing member is installed and connected to the tower by its Cable-Stay. The cable referred to may be one cable or a multiple of cables grouped together. The afore-described tensioning and anchorage structure is well known and not unique to the present invention. Accordingly, it has not been illustrated. The long beam framing members as part of the roof structure may be a beam, a truss, or other means or of any material.

Thereafter a back-stay cable 42 is installed in like manner between the anchorage and the tower. The back-stay cables as well may be singular cables or multiple cables. All cables are of fixed length with sockets at both ends. The cables may be sloped at the angle shown or may be sloped at a steeper angle so that the anchors are closer to the stadium. The back-stay cables may also be sloped at a flatter angle placing the anchors at a further distance from the stadium than shown. The cables can be attached first at either the tower or at the anchorage and then pulled into place at the opposite end by the method described above. The cables can be supported on a temporary falsework or scaffolding or a suspended cable construction footwalk for their erection, or they can be installed without these measures.

Figure 10:
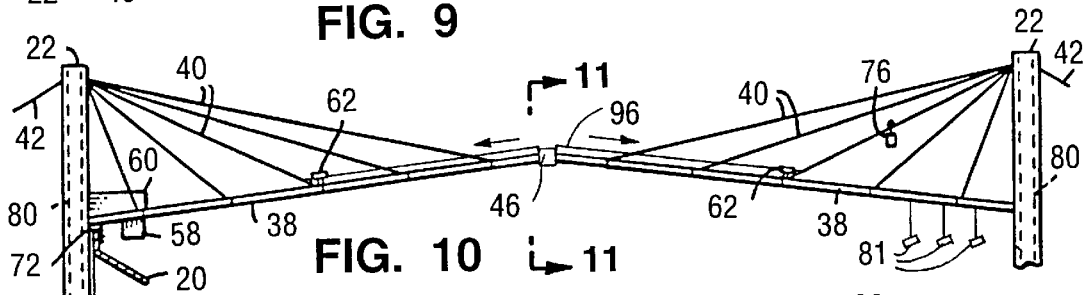
FIG. 10 is an elevational sectional view through the center of the roof showing water jets on the roof, a boatswains chair or basket on the cables for access, a roof restaurant, a flexible closure gasket between the roof edge and the stadium, suspended luxury seating boxes, and suspended infrared radiant heaters.
Figure 11:
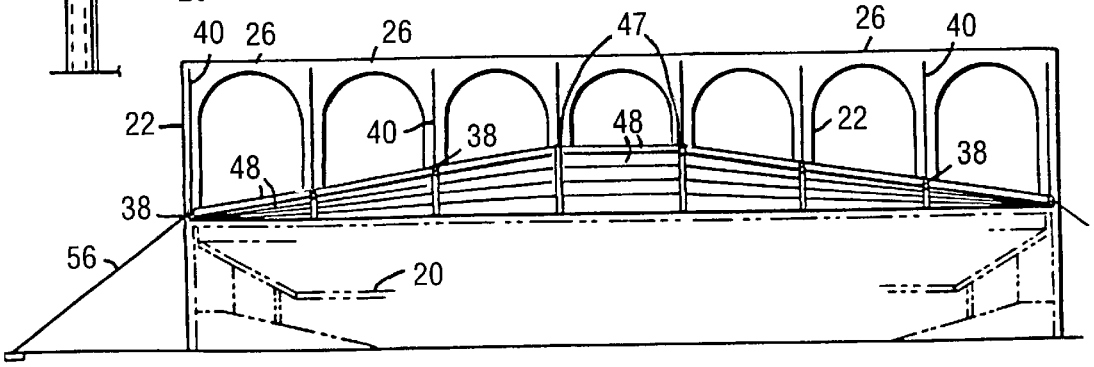
FIG. 11 a cross-sectional view taken on line 11—11 of FIG. 10, also showing hold down and sidesway cables.

The cables, as stated, can be either singular or multiple cables. Where they are multiple cables they are connected together at intermediate points. A boatswains chair or basket suspended from the cables may be used for access to perform this operation. See 76 in FIG. 10.

The cables after they are installed receive a final coat of paint. A boatswains chair may be used again which may also later be used for repainting and inspection. Other types of cables other than described may also be used, and the method of installation may vary, but the end configuration is not changed.

For an example the cables might be fabricated to be continuous over the towers supported on saddle supports in the towers and then connected at one end to a long beam framing member 38 and the other end to a ground anchorage 28 and then tensioned at one or the other end.

For another example, the tensioning of the cables may be made by jacking the cable support in the tower upward either in addition to the tensioning made at the ends of the cables or entirely in this manner.

Figure 12:
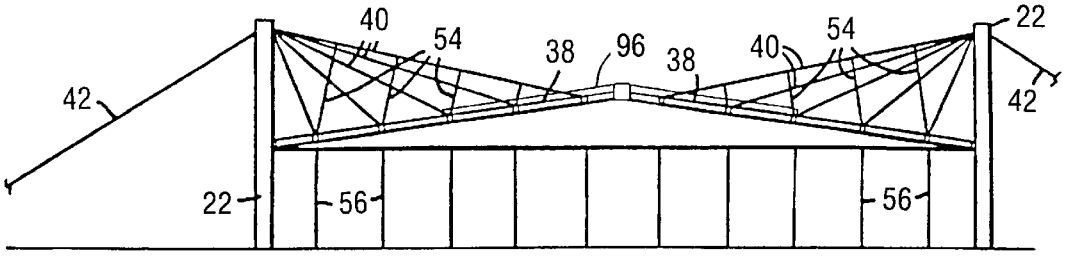
FIG. 12 is a view similar to FIG. 10, but also showing hold down sidesway cables at the roof's edge. Also shown are cross-cables or struts between the Cable-Stays to limit wind structural vibration of the cables, to control cable vibration noise control, and to enhance roof stiffness. These cables might not be needed.

After all cables are installed the cables may be connected between Cable-Stays by other cross-cables 54 or by struts 54 to dampen any wind induced or earthquake induced vibrations which could develop. (see FIG. 12). This also increases the general stiffness of the roof. Vibration dampers consisting of shock absorbers or rubber ring dampers may also be installed at the cable connection points.

Figure 8:
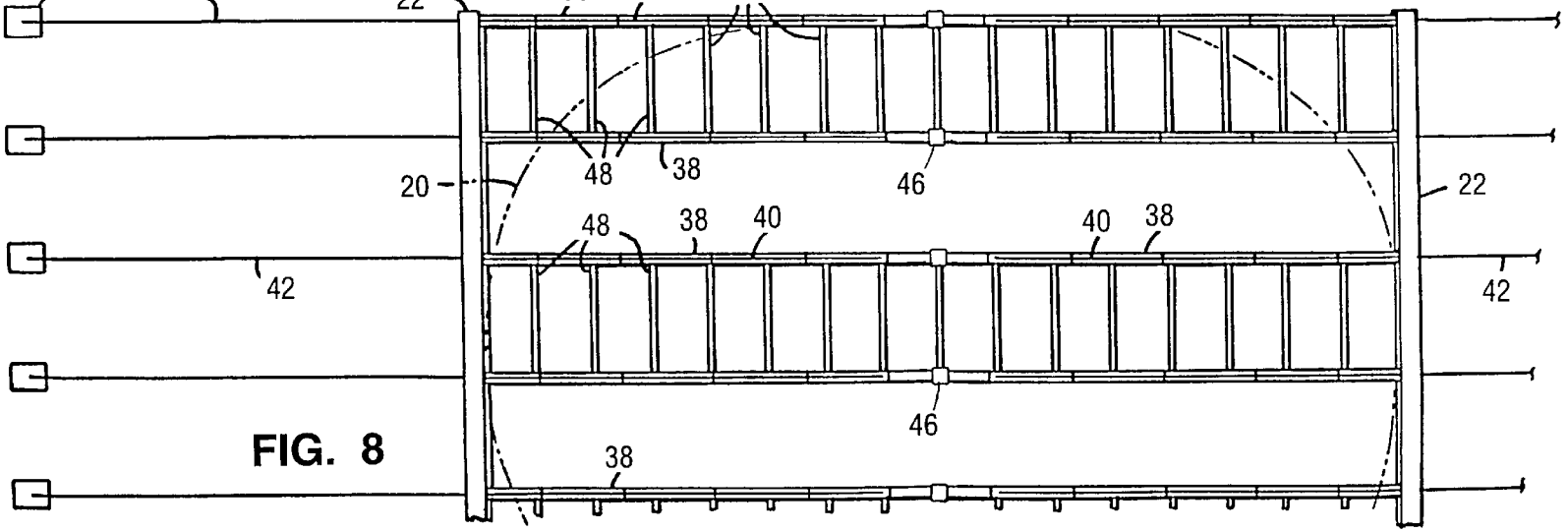
FIG. 8 is a plan view of an intermediate first stage of the roof construction, showing every other roof section constructed.

Now after the initial long beam framing member 38*a* is installed as described to this point, FIG. 3, a second is installed in like manner from the next adjacent tower leg and intermediate framing 48 is installed, as seen in FIG. 8, by being secured between the long beam framing members 38. The intermediate framing 48 may be of many different types. It may be open web steel joists, a space frame, or tubular steel joists, or wide flange steel beams, or any other framing system. A tubular steel system is shown in the drawings for the intermediate framing system. The intermediate roof framing 48 by definition is all framing located between the roof long beam framing members 38 with the exception of the retractable roof framing (136).

A safety net is now installed to extend under all cantilevered construction.

The roof construction now proceeds in similar fashion as by the initial framing member installation described above, but with each successive long beam framing member attached to the end of the last installed long beam framing member. The procedure repeats itself until one cantilevered section is built out to the center area of the roof where they meet from opposite sides 46. Alternate sections which might be 80 feet in width are built first so that the constructed unit hangs evenly. A completed cantilevered section, one half the span of the stadium, may be 425' in length.

The roof is constructed as above from two sides of the stadium and joined in the middle. It is built either from both sides simultaneously or one side at a time.

Figure 14:
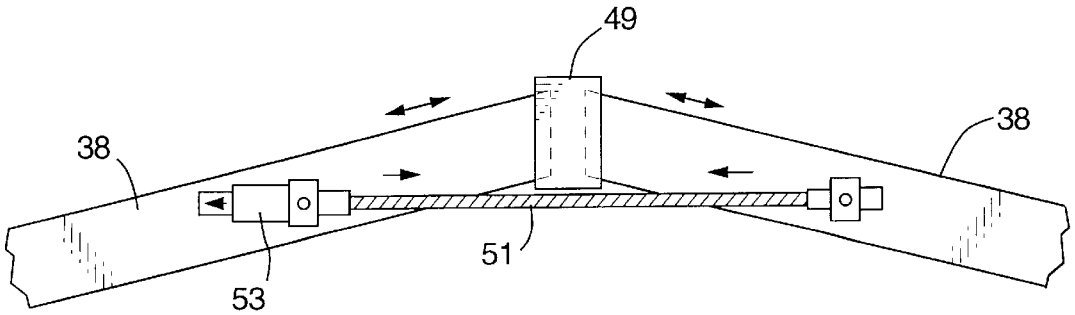
FIG. 14 is an elevational view, with parts thereof broken away, showing the slip joint or flexible joint where the roof long beam framing members meet over the center area of the roof providing for structural movement due to temperature and other causes and allowing tensioning with a flexible cable connection as per my U.S. Pat. No. 4,802,314.
Figure 15:
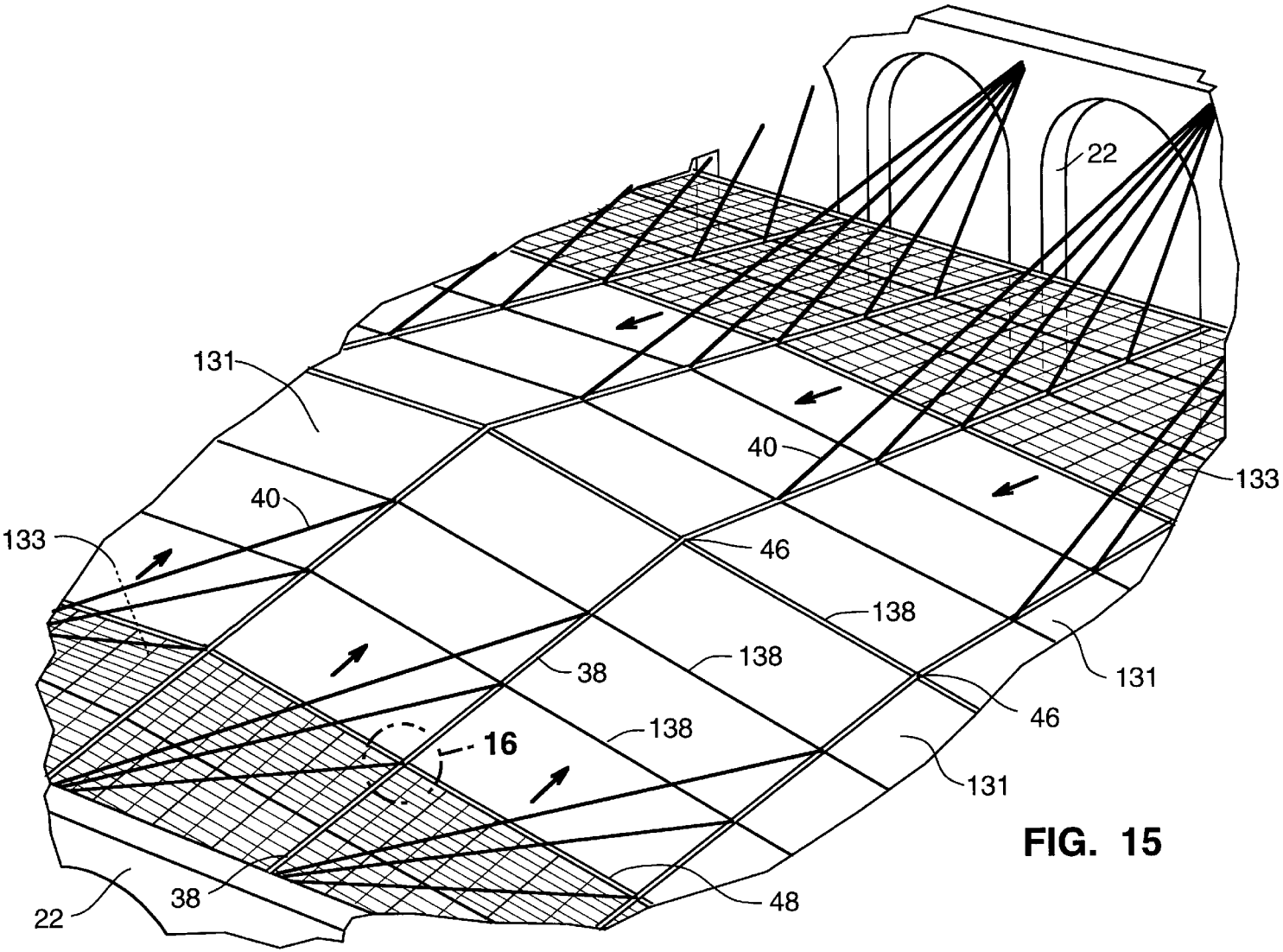
FIG. 15 is a perspective view showing an area of the skylight roof in the open position showing lateral bracing (138) and long beams (38) left in place over the stadium opening.
Figure 16:
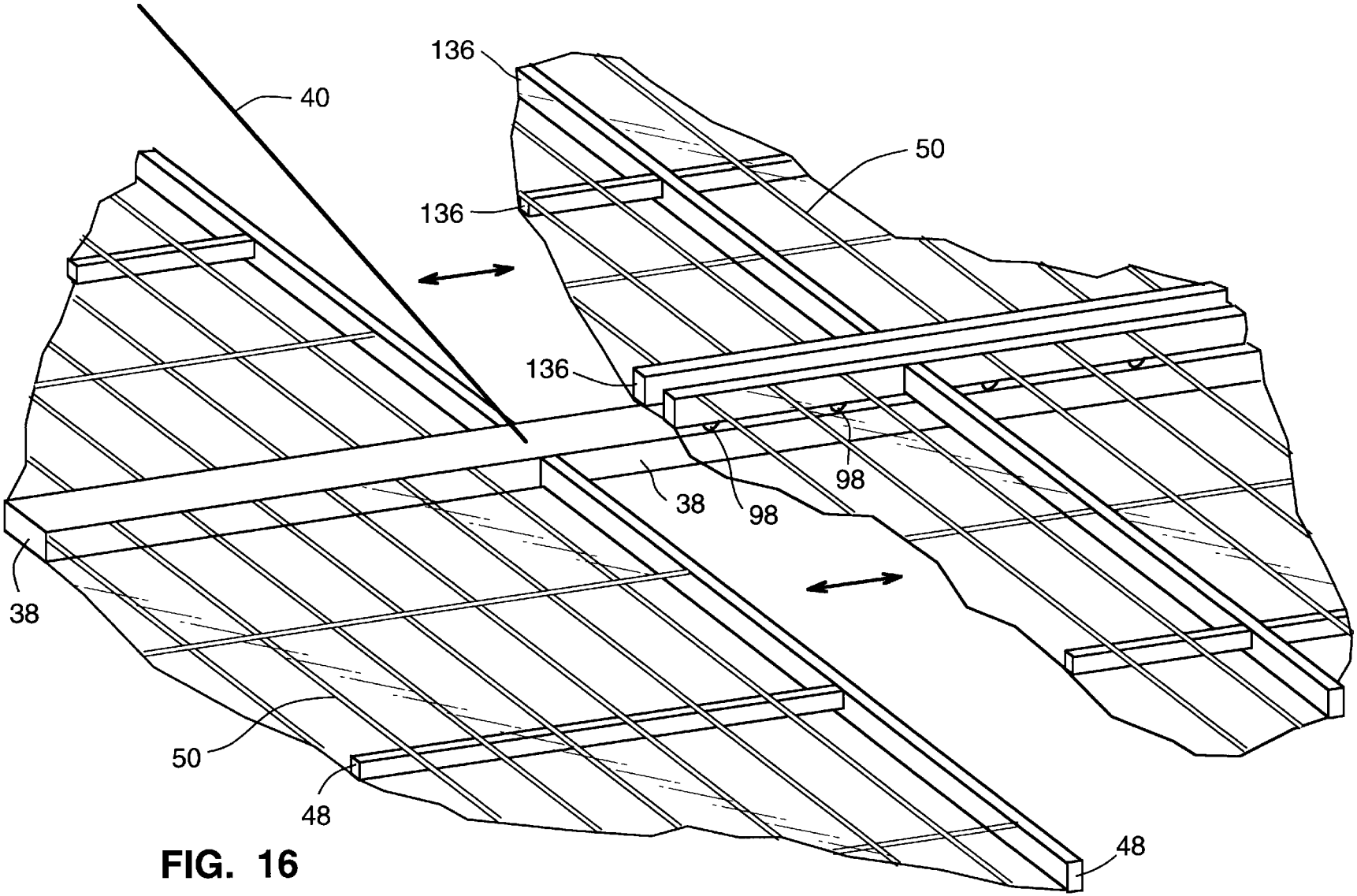
FIG. 16 is a perspective view, with parts thereof broken away, showing the retractable roof framing (136) and how it slides over the permanent intermediate framing (48), both framings supporting a skylight cover (50).

The next step is the joining in the middle of the long beams provided by the framing members (38). This is done in such a manner as to allow for future movement of the long beams due to temperature changes and other causes. The connecting structure is shown in FIG. 14 and comprises a slip joint provided by a sleeve 49 between the opposed cantilevered long beams and a tension cable 51 secured between the beams. A turnbuckle 53 provides for select adjustment of the tension on cable 51 and control of the long beam force exerted on the tower legs at the edge of the roof.

Now hold-down and sidesway cables 56 are installed as needed between the roof edge and the ground or stadium structure. Hold-down or sidesway cables may be eliminated by supporting the roof structure to the underlying stadium. From FIG. 1 it will be seen that the long beams 38 and the resultant roof sections slope upward from the towers to the central portion of the roof and that the roof also slopes laterally from the central area to the edges. The outermost beams 38 to which the cables 58 are joined are essentially horizontal.

After the roof framing is installed, the retractable roof framing (136) is installed. This is framing that is generally identical to the intermediate framing (48), but installed on wheels set over the long beams (38) so as to slide over the long beams or other parts of the structure (133). New lateral bracing (138) is installed between the long beams in the area of the roof opening so when the retractable roof framing is retracted the long beams (38) retain lateral support.

The retractable roof framing (136) is constructed to rest on wheels that run the length of the long beams (38) to facilitate sliding the roof. These wheels may be steel wheels resting on rails mounted on the long beams or rubber or other type of wheels running directly on the surface of the long beams (38). The sliding can also be made without wheels on teflon bearings or on direct acting roller bearings or other equivalent means.

Figure 17:
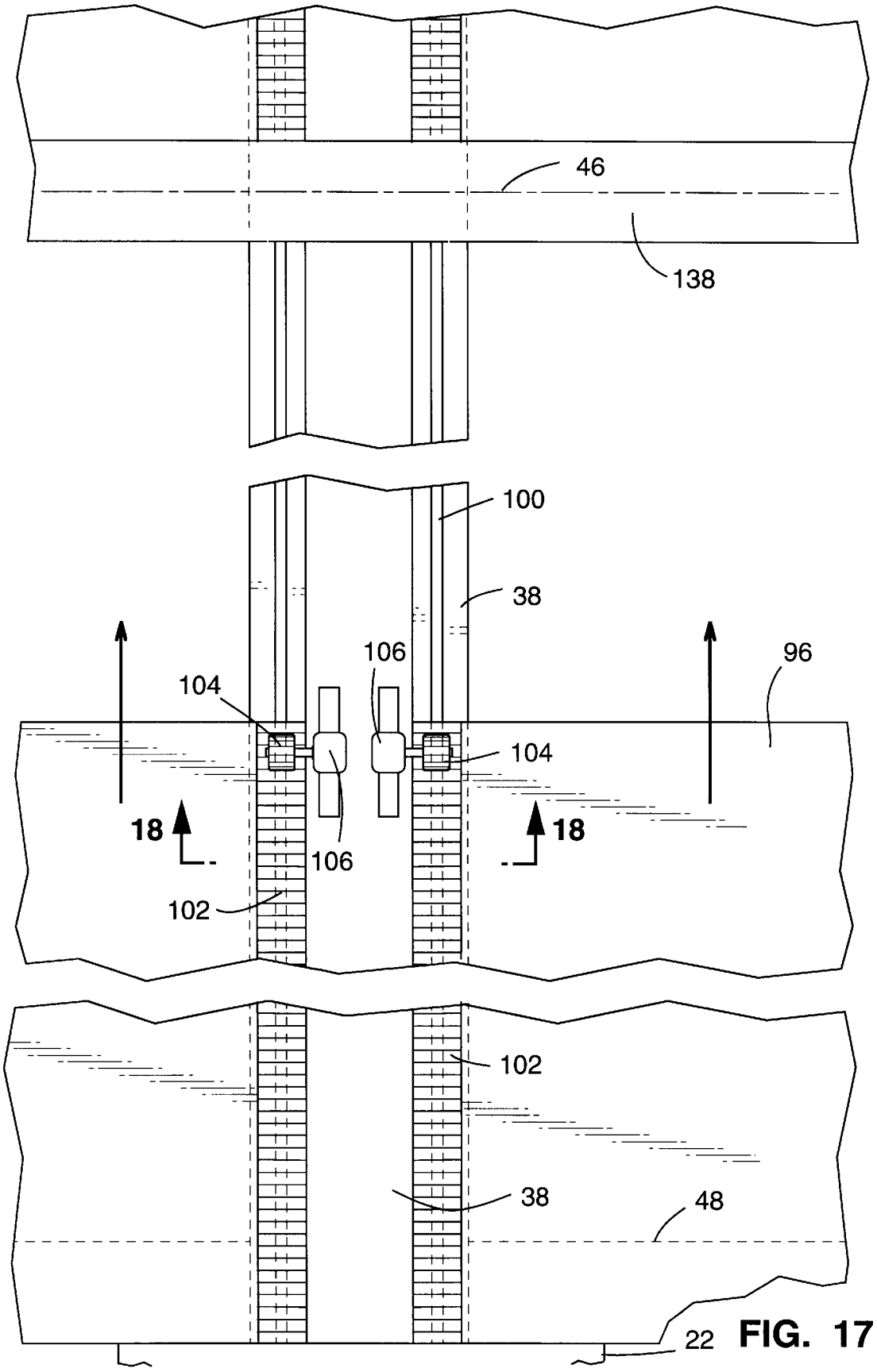
FIG. 17 is a plan view and FIG. 18 is a sectional view taken on the plane designated 18—18 in FIG. 17, showing a rack and pinion drive mechanism for retracting the roof.
Figure 18:
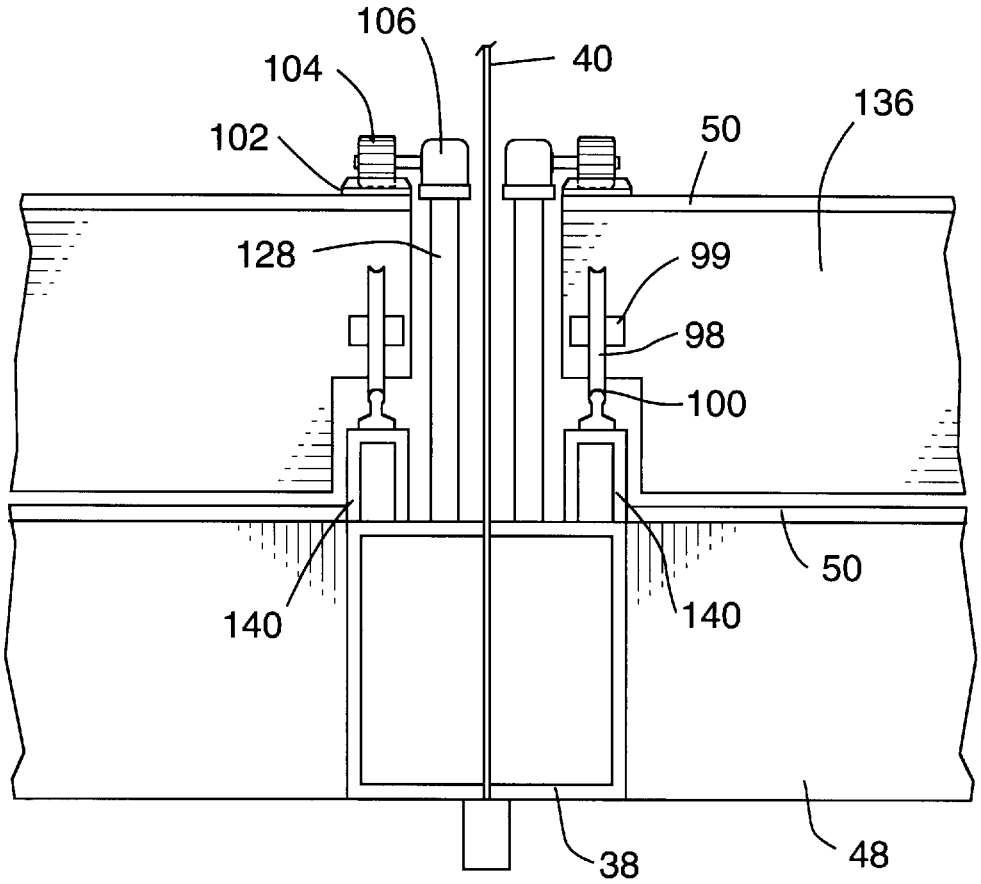

As seen in FIGS. 17 and 18, movement of the retractable roof framing, which might be a section of roof 200 feet by 80 feet, is made with a motor driven pinion gear drive mounted on the long beam (38). The pinion gear drive engages a rack (102) rigidly mounted on the top of the retractable roof framework. By the motor (106) turning the pinion gear (104), the retractable roof is moved laterally what could be about 200 feet from the open to the closed or vice versa. An 80 foot by 200 foot retractable roof framing section with a glass skylight thereon will weigh about 200 tons. The motor driving the pinion would be sized accordingly and could be either electric or hydraulic. Control mechanisms are used to provide even movement so the retractable framing moves evenly along each of two long beams on which each moveable retractable framing rests. The Cable-Stay roof structure has a very high rigidity, thereby, allowing the movement of very large and heavy roof sections without glass breakage.

Figure 19:
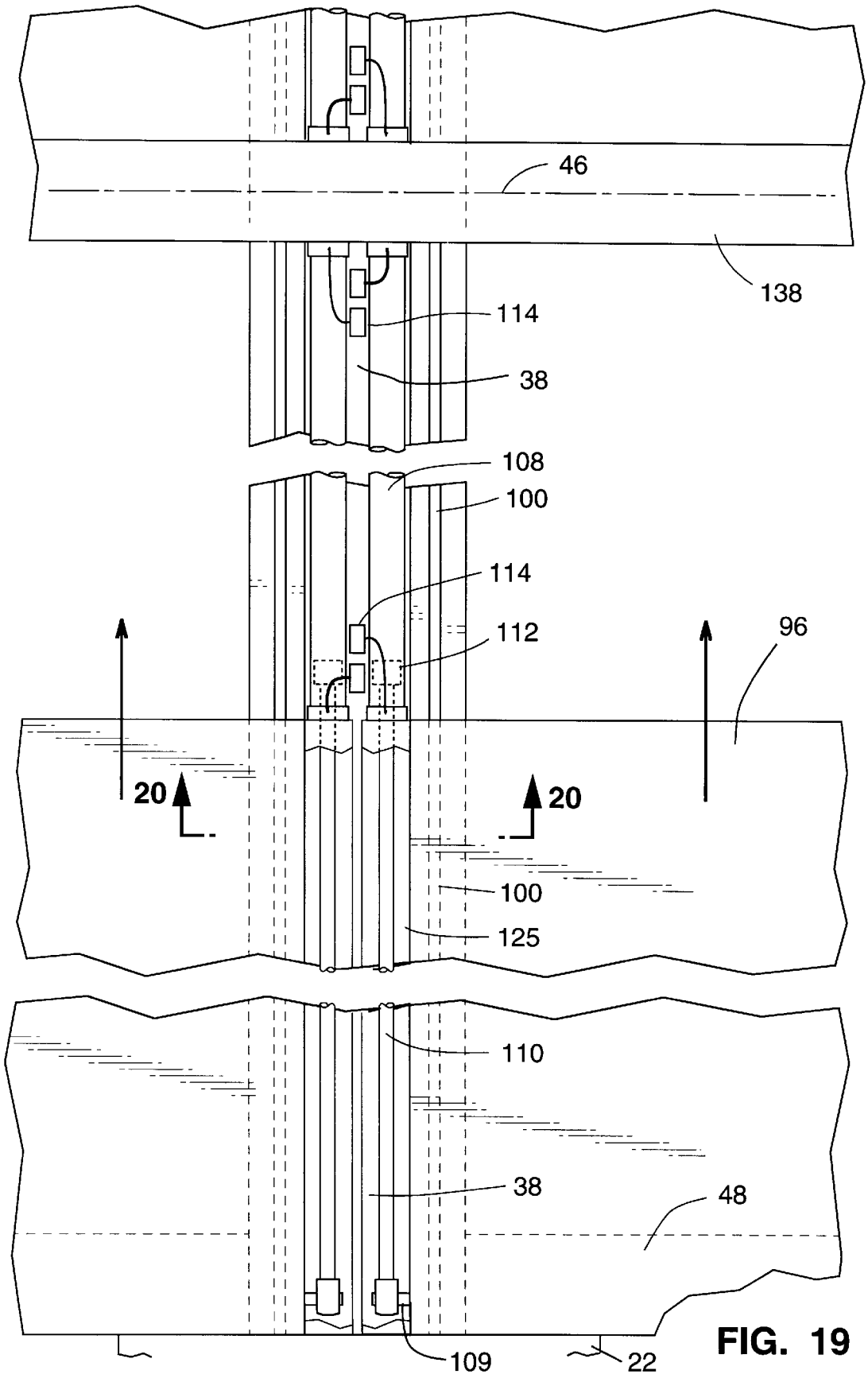
FIG. 19 is a plan view and FIG. 20 is a sectional view taken on the plane designated 20—20 in FIG. 19, showing a hydraulic rod and cylinder construction to open and close the roof.
Figure 20:
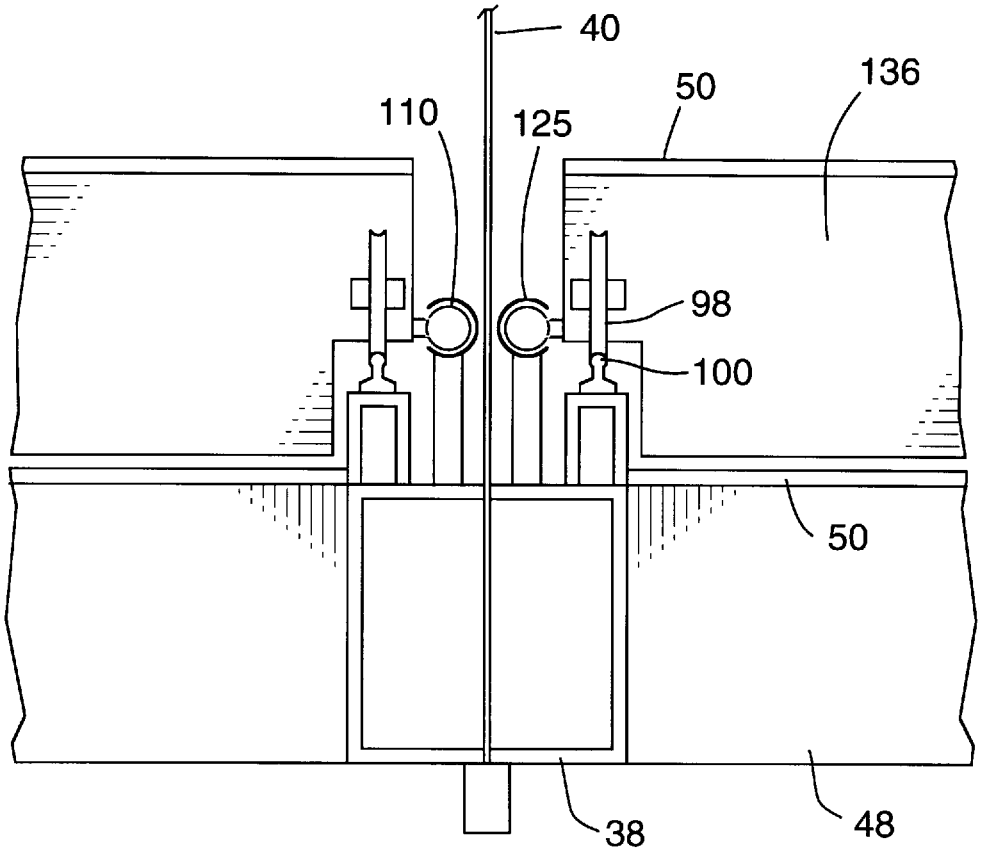
Figure 21:
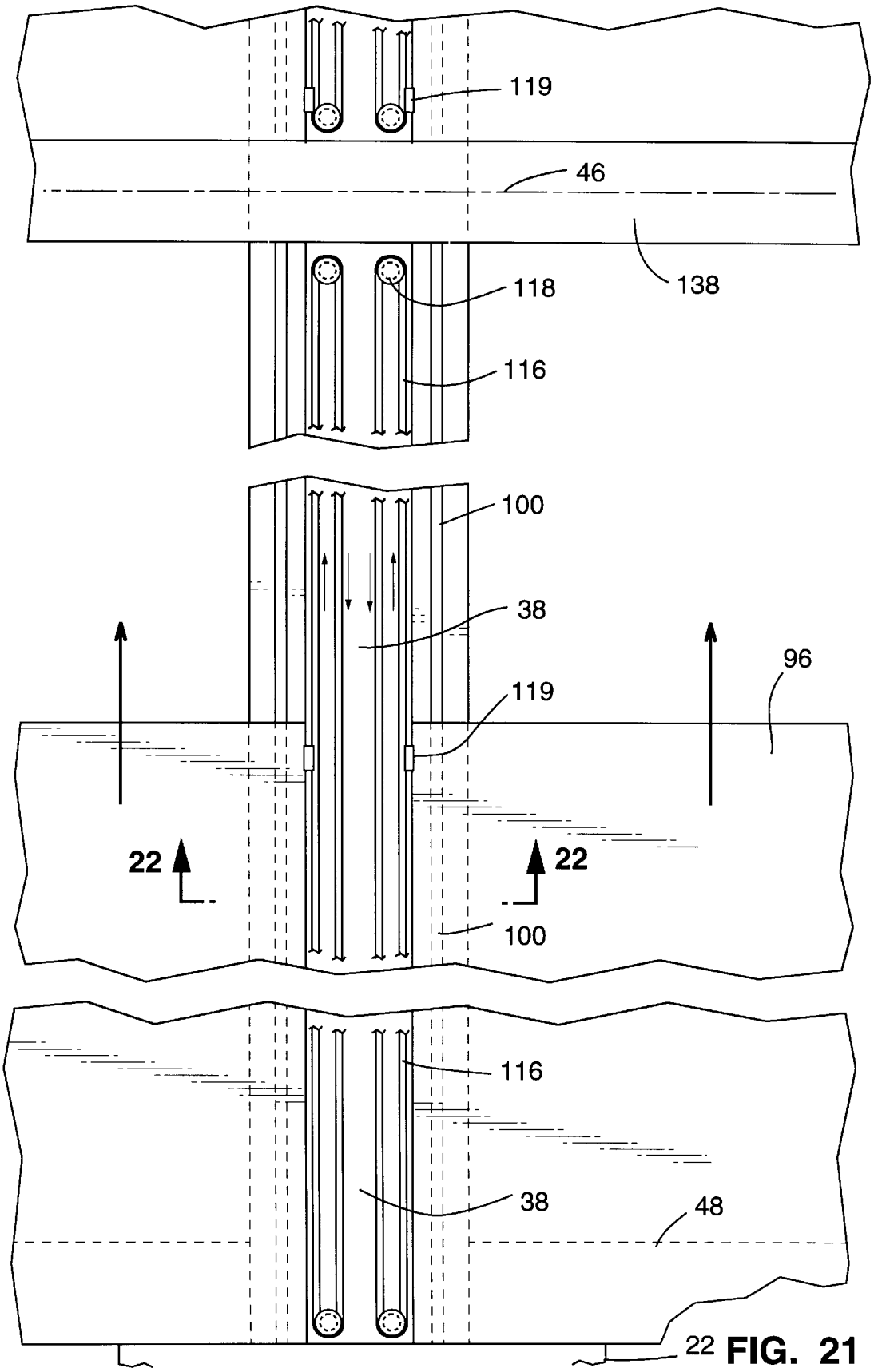
FIG. 21 is a plan view and FIG. 22 is a sectional view taken on the plane designated 22—22 in FIG. 21, showing a link chain or cable structure for opening and closing the roof or called pulley.
Figure 22:
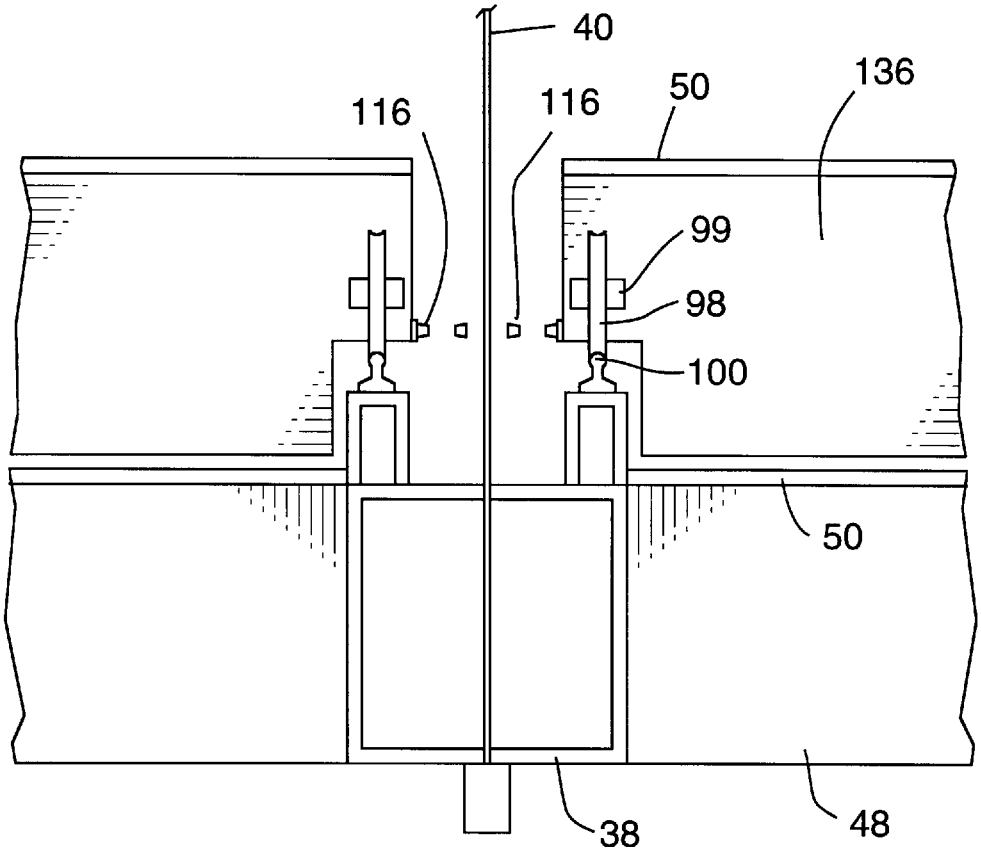
Figure 23:
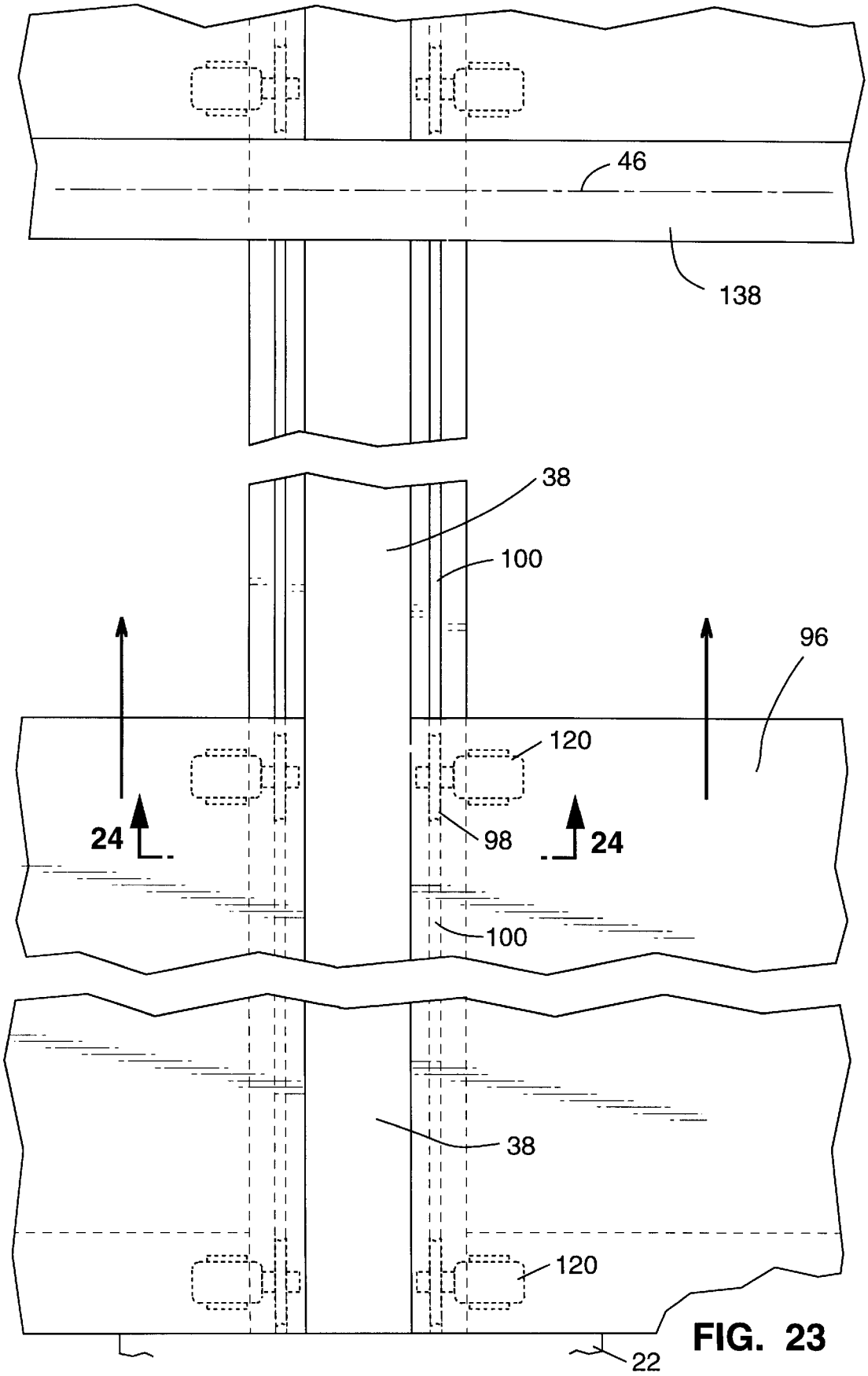
FIG. 23 is a plan view and FIG. 24 is a sectional view taken on the plane designated 24—24 in FIG. 23, showing a motor to wheel drive for opening and closing the roof or called traction method.
Figure 24:
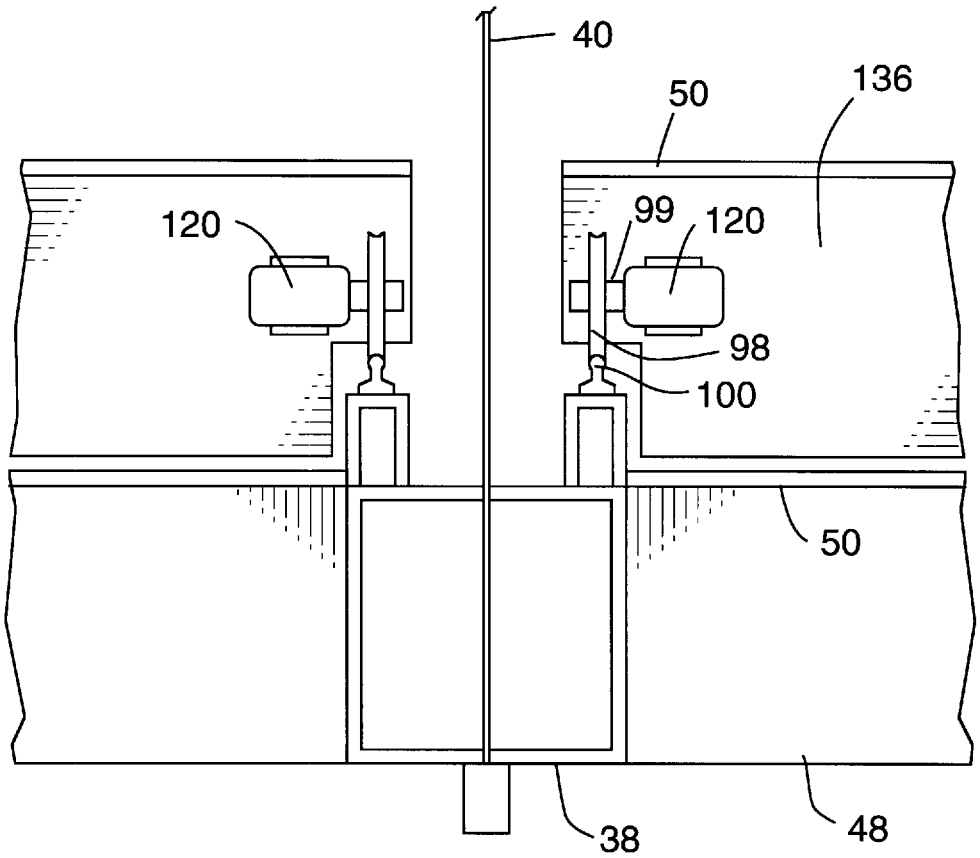
Figure 25:
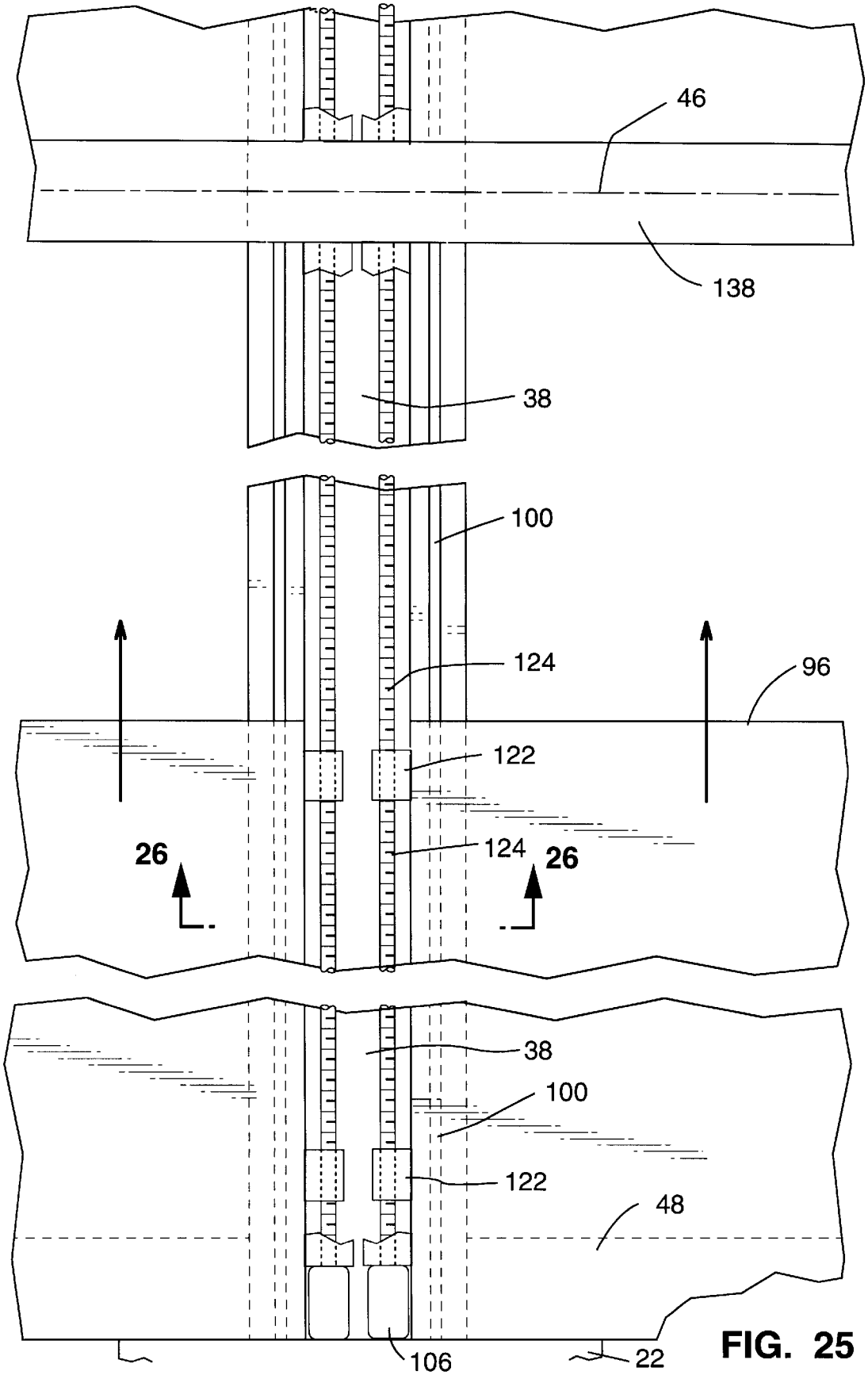
FIG. 25 is a plan view and FIG. 26 is a sectional view taken on the plane designated 26—26 in FIG. 25, showing the "screw method" wherein a spiral gear thread rod and moveable roof connector are used for opening and closing the roof.
Figure 26:
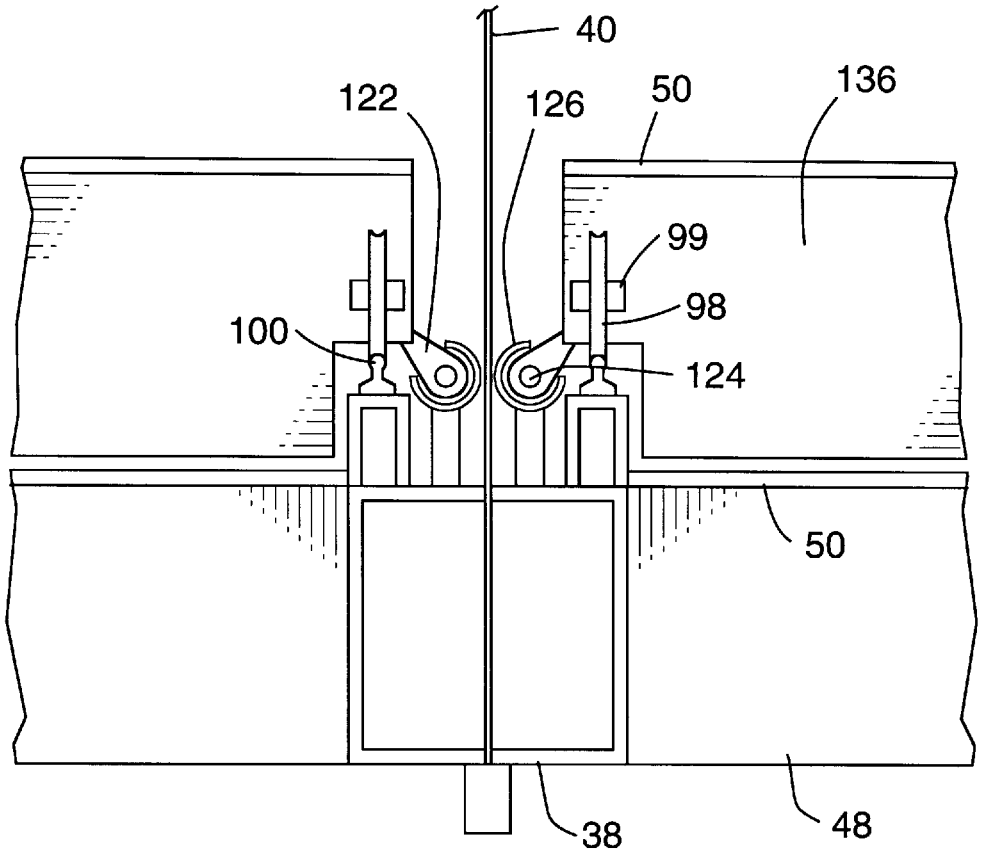

Other means to accomplish the same movement of the retractable framing can be (a) a hydraulic cylinder and rod, FIGS. 19 and 20, (b) link chain or wire rope driver, FIGS. 21 and 22, (c) a direct motor to wheel drive, FIGS. 23 and 24, (d) a spiral gear thread rod and motor drive with moveable roof connector, FIGS. 25 and 26, or other equivalent means.

Over the retractable roof framing (136) and over the fixed roof framing or intermediate framing (48) is next installed the glass or plastic skylight (50) generally made of an aluminum frame with glass or plastic panels.

The preferred embodiment would have the glass a coated glass. The glass might also include polarizing elements set opposite so when the moveable glass is moved over the fixed glass the light transmission is cancelled. The panels might also include electrochromic means to vary the light transmission, although this would be very expensive as the technology is not so far advanced.

The roof is made watertight by a raised curb (140) set on the long beams (38) to permit the top of the beams to serve as a channel for drainage. The retractable roof is higher and is sloped over the fixed permanent roof area so natural drainage can occur out to the roof perimeter.

Interference with the Cable-Stays (40) is avoided as they occupy only a narrow center area of the long beams (38).

The retractable roof in combination with the Cable-Stay roof forms the improvement over my earlier patents, U.S. Pat. No. 4,802,312, issued Feb. 7, 1989 and U.S. Pat. No. 5,010,695, issued Apr. 30, 1991, both for a Cable-Stay skylight stadium roof with opening mechanism for ventilation.

The earlier patents showed methods for opening the individual lites of the skylight for ventilation, a typical light being 7'6"×12'.

This new retractable roof provides for the opening of panels that are typically 80 feet by 200 feet weighing 200 tons and teaches how to open them to make a total opening that may be 5 acres in size or 50% or more of the stadium area to create an outdoor stadium, and it shows how to do this in glass.

The earlier patents, although primarily directed to a plastic hinged type opening lite 7'6"×12', also mention the possibility of sliding these units to open them. But this involved moving only the glass and aluminum skylight whereas the new method moves the underlying framing of the roof with the glass and aluminum skylight thereon.

Suspended from the roof and balcony of the stadium are infrared heaters 81 to provide radiant heat where needed to the stadium.

Figure 9:
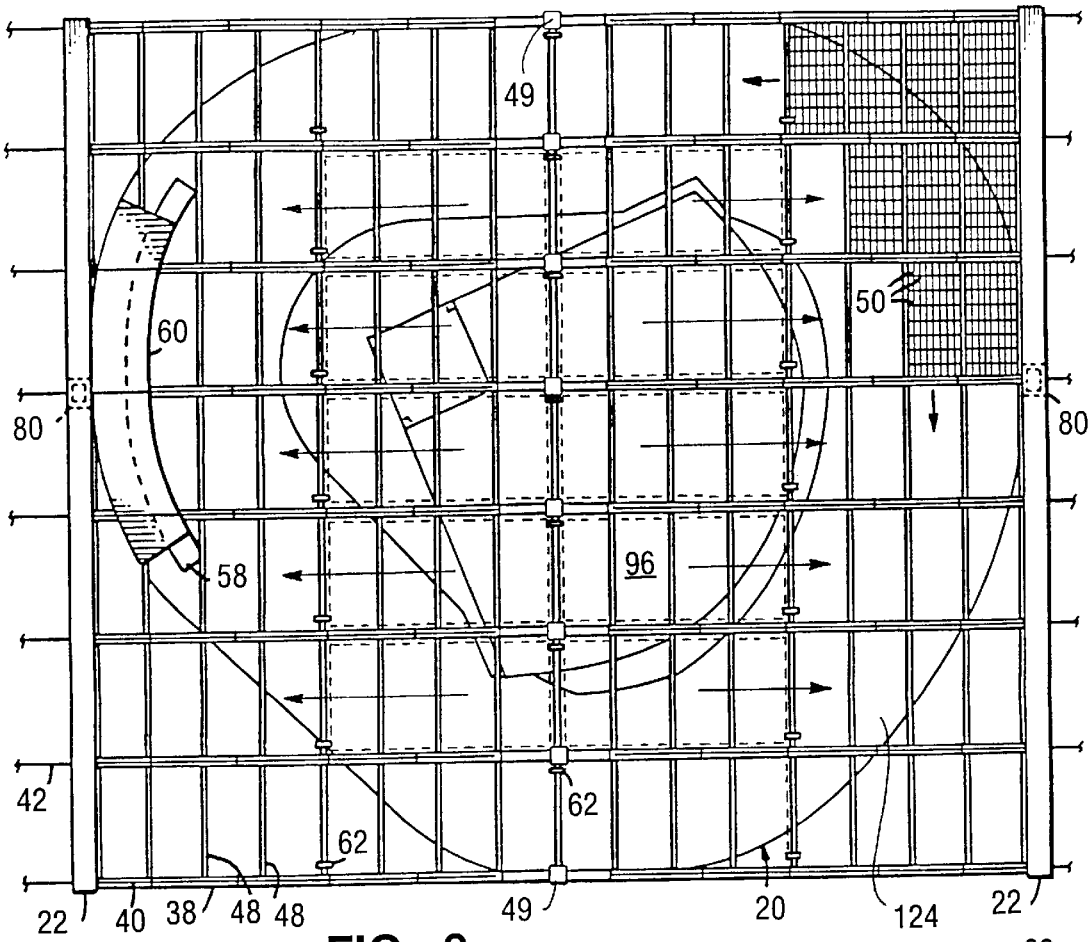
FIG. 9 is a plan view of the roof with all sections completed, including a roof restaurant, luxury seating boxes, water jets for cleaning, beam walkways, and the form of roof retractability.

The roof as so constructed overlaps the stadium rim in such a manner that no rain and only minor amounts of wind can enter, but ventilation can occur. (see FIG. 9). The roof is left unconnected to the stadium to allow for independent structural movement. The roof overlaps the rim of the stadium to provide some protection to the concourse and other areas around the stadium.

The space between the roof and the stadium rim is made of sufficient size, possibly 8', to allow for desired ventilation. The roof, however, may be connected at this point to the stadium if so desired and the space may be closed. The closure may be a flexible gasket. See 72 FIG. 10.

Where built over an existing stadium, stadium stanchion lighting 73 (see FIG. 1) where existing is left in place or where interference with the roof tower assembly 22 and 26 occurs, remounted on the roof tower assembly. These lights can then project through the completed clear skylight roof illuminating the stadium interior.

Primary lighting is installed on the underside of the roof beams in a new stadium.

Additional details of construction include: roof drainage and downspouts (not illustrated) roof condensation gutters on the underside of the roof (not illustrated) high pressure water cleaning jets 62 on the roof for cleaning; elevators 80 installed in the towers for access to the top of the towers and the roof; walkways and handrails formed on the tower tops and on the roof beams 38 for maintenance and sightseeing; a restaurant 60 constructed on the roof (see FIGS. 9 and 10); and luxury boxes 58 for private seating built on the roof or suspended from the roof.

It is to be understood that while the subject invention has been described with reference to a preferred method of assembly, other variations could be made by one skilled in the art without varying from the scope and the spirit of the subject invention as defined by the appended claims.

What is claimed is:

1. A cable stay retractable roof built over an area to be roofed, comprising:

(a) towers set on opposite sides of the area to be roofed;

(b) a roof frame comprised of spaced elongate members extending from the towers from opposite sides and spaced transverse members extending between adjacent elongate members, the elongate members extending from opposite sides being aligned and meeting in a center area of the roof;

(c) multiple cable stays extending to each elongate roof member from one or more of the towers to support the member;

(d) fixed roof framing installed between said elongate roof members laterally and to the outside of the center area of the roof to provide closed lateral roof areas that are fixed and an open central area of the roof that is spanned by the elongate members of the roof frame;

(e) retractable roof framing comprising longitudinally movable roof panel structures disposed over said elongate and transverse members of the roof frame and supported by said elongate members for movement between positions closing the open center area of the roof and positions disposed over the lateral roof areas to open the open center area, said movable roof panel structures each spanning the space between adjacent elongate members whereby each said panel structure covers the space between adjacent elongate members and said panel structures provide space therebetween for the cable stays to permit the panel structures to move longitudinally along the elongate members;

(f) rollable supports between the retractable roof framing and the elongate members to facilitate select slidable movement of the retractable roof framing over said open center area and, (g) occupant carrying compartments suspended from the roof frame.

2. A cable stay retractable roof built over an area to be roofed, comprising:

(a) towers set on opposite sides of the area to be roofed;

(b) a roof frame comprised of spaced elongate members extending from the towers from opposite sides and spaced transverse members extending between adjacent elongate members, the elongate members extending from opposite sides being aligned and extending across a center area of the roof;

(c) multiple cable stays extending to each elongate roof member from one or more of the towers to support the member;

(d) fixed roof framing installed between said elongate roof members laterally and to the outside of the center area of the roof to provide closed lateral roof areas that are fixed and an open center area of the roof that is spanned by the elongate members of the roof frame;

(e) retractable roof framing comprising longitudinally movable roof panel structures disposed over said elongate and transverse members of the roof frame and supported by said elongate members for movement between positions closing the open center area of the roof and positions disposed over the lateral roof areas to open the open center area, said movable roof panel structures each spanning the space between adjacent elongate members whereby each said panel structure covers the space between adjacent elongate members and said panel structures provide space therebetween for the cable stays to permit the panel structures to move longitudinally along the elongate members;

(f) rollable supports between the retractable roof framing and the elongate members to facilitate select slidable movement of the retractable roof framing over said open center area; and, (g) occupant carrying compartments suspended from the roof frame.

* * * * *